US007017501B2

(12) United States Patent
Mann

(10) Patent No.: US 7,017,501 B2
(45) Date of Patent: Mar. 28, 2006

(54) RIFFLE DISTRIBUTOR ASSEMBLY FOR A FOSSIL FUEL FIRED COMBUSTION ARRANGEMENT

(75) Inventor: Jeffrey Scott Mann, Windsor, CT (US)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 10/762,624

(22) Filed: Jan. 22, 2004

(65) Prior Publication Data

US 2005/0160953 A1 Jul. 28, 2005

(51) Int. Cl.
*F23K 3/02* (2006.01)
*F23K 1/00* (2006.01)

(52) U.S. Cl. ..... 110/104 R; 110/106; 209/506

(58) Field of Classification Search ..... 209/506, 209/44, 143, 437, 458; 406/182, 113, 195, 406/181, 183; 110/104 R, 106
See application file for complete search history.

(56) References Cited

U.S. PATENT DOCUMENTS

| | | | | |
|---|---|---|---|---|
| 1,757,634 A | | 5/1930 | Jacques | |
| 1,911,543 A | | 5/1933 | Bailey | |
| 2,780,186 A | | 2/1957 | Andrews | |
| 2,975,001 A | | 3/1961 | Davis | |
| 5,685,240 A | * | 11/1997 | Briggs et al. | 110/106 |
| 5,934,205 A | * | 8/1999 | Gordon et al. | 110/101 R |
| 6,055,914 A | * | 5/2000 | Wark | 110/104 R |
| 6,789,488 B1 | * | 9/2004 | Levy et al. | 110/348 |
| 2003/0205181 A1 | | 11/2003 | Levy et al. | |

FOREIGN PATENT DOCUMENTS

| | | |
|---|---|---|
| GB | 637319 | 5/1950 |
| WO | WO 03/048643 | 6/2003 |

OTHER PUBLICATIONS

European Search Report dated Apr. 18, 2005 (EP Application No. 04031010.4).

* cited by examiner

*Primary Examiner*—Kenneth Rinehart
(74) *Attorney, Agent, or Firm*—Timothy J. Olson; Arthur E. Fournier, Jr.

(57) ABSTRACT

A riffle distributor assembly for influencing the travel properties of a material feed stream 42 moving between a pulverizer 14 and a furnace 12 is part of a feed path 36 having one duct 44A having a branch entry 66A and another branch duct 44C having a branch entry 66C both downstream of upstream passage peripheries UPZ defined between adjacent intake vanes 114 through which the feed stream of the material 42 travels in two segregated portions. A motor drive assembly 58 moves the intake vanes 114 relative to the incoming flow reference axis IFA, whereupon intake areas defined between adjacent intake vanes 114 moves relative to the incoming flow reference axis IFA such that the travel properties of the one portion of material in the one branch duct 44A are different than its travel properties before the movement of intake areas defined between adjacent intake vanes 114.

3 Claims, 9 Drawing Sheets

RIFFLE DISTRIBUTOR ASSEMBLY FOR A FOSSIL FUEL FIRED COMBUSTION ARRANGEMENT

BACKGROUND OF THE INVENTION

The present invention relates to a riffle distributor assembly for a fossil fuel fired combustion arrangement and, more particularly, to a riffle distributor assembly for a fossil fuel fired combustion arrangement of the type having fossil fuel delivery systems that deliver pulverized coal to coal fired steam generators.

Coal fired furnaces are typically provided with a plurality of ducts or pipes through which pulverized coal and air is directed to a plurality of fuel-air admission assemblies arrayed in respective vertically extending windboxes. The windboxes are disposed in one or more walls of the furnace and each introduces coal and air into the furnace.

Pulverized coal firing is favored over other methods of burning coal because pulverized coal burns like gas and, therefore, fires are easily lighted and controlled. Such systems may include one or more pulverizers, also referred to as mills, that are used to grind or comminute the fuel or, alternatively, may not include any pulverizer because a supply of pulverized coal available.

The pipes directing the coal to the respective windboxes are large and cumbersome. Typically the pipes are provided with large couplings or bolted flanges to couple the end abutting axially adjacent portions together. The normal nozzle assembly requires regular maintenance because the pulverized coal has a severe erosive effect. A typical pulverizer will move between 7 and 50 tons of coal every hour. The coal typically moves at a velocity of 75–90 feet per second within the fuel transport pipe.

A typical coal distribution system includes a number of distributors intended to split the flow of air and pulverized coal into two discrete pipes. It is desired that the distributors take the homogeneous mixture of pulverized coal and deliver identical quantities of that homogeneous flow to each of the two discrete pipes. Each of these distributors is a Y-shaped duct. Each of these Y-shaped ducts has an inlet and two outlets. U.S. Pat. No. 5,934,205 to Gordon et al discloses a Y-shaped distributor body and a splitter disposed in the distributor body for dividing a flow of pulverized coal between first and second outlets.

In connection with the feed of pulverized coal to the feed burner nozzles of a combustion chamber, U.S. Pat. No. 6,055,914 to Wark notes that an exhauster fan first throws the coal radially into a primary discharge chute and that the flow of coal/air leaving the exhauster fan is uneven, whereby the coal/air flow to the burners tends to be light on one side or wall of the chute and heavy on the other side or wall of the chute in terms of both particle size and distribution.

U.S. Pat. No. 6,055,914 to Wark describes a prior art solution which involves providing "riffle boxes" in the chute between the fan and the burners. A riffle box is a series of vertical, spaced plates separated by angled separator bars with alternating orientation from plate to plate and U.S. Pat. No. 6,055,914 to Wark notes that, in accordance with one theory, it is believed that the separator bars on one plate will deflect the coal in one direction, while the separator bars on adjacent plates will deflect the coal in the opposite direction, thereby splitting and redistributing the flow for a more homogeneous mixture. It is further noted in this reference that the typical arrangement is to provide a series of riffle boxes, with a first riffle box splitting the flow like a "Y" into two chute branches, and a subsequent riffle box on each of the first two branches splitting the flow again into a total of four chutes. Each chute typically fuels one of four corner-mounted burners in a tangentially-fired combustion chamber.

U.S. Pat. No. 6,055,914 to Wark notes that the riffle boxes have proven ineffective in providing a more homogeneous mixture to the burners, and the coal/air flow reaching the four combustion chamber burners differs significantly from burner to burner. The reference cites several problems which result from a riffle box arrangement: too lean a mixture at a burner can create NOX; oversized particles and inefficient burning create LOI (loss on ignition) contamination of the ash byproduct and reduced combustion efficiency; and, perhaps most importantly, the out-of-balance burner flow distorts the combustion chamber fireball from the ideal spherical shape to an undesirable elliptical shape, creating hot and cold spots in the boiler tubes and causing gas control problems.

SUMMARY OF THE INVENTION

It is an object of the present invention to provide a riffle distributor assembly for a fossil fuel fired combustion arrangement that will advantageously substantially uniformly distribute a single stream of fossil fuel into a pair of fossil fuel branch feed paths.

Another object of the invention is to provide a riffle distributor assembly for a fossil fuel fired combustion arrangement that permits more precise and reliable control of the distribution of the material between two or more branch feed paths.

A further object of the present invention is to provide a riffle distributor assembly for a fossil fuel fired combustion arrangement that distributes material between two or more branch feed paths in a manner which minimizes any loss of pressure.

An additional object of the present invention is to provide a riffle distributor assembly for a fossil fuel fired combustion arrangement of the type having fossil fuel delivery systems that deliver pulverized coal to coal fired steam generators such that the riffle elements will advantageously substantially uniformly distribute a single stream of pulverized coal into a pair of pulverized coal branch feed paths.

In accordance with one aspect of the present invention, it has now been found that these and other objects of the invention may be attained in an apparatus for influencing the travel properties of a material moving between a material supply source and a delivery location which includes means forming a feed path along which material travels as the material is enroute from the material supply source to the delivery location and a riffle distributor assembly. In accordance with further details of the one aspect of the present invention, the feed path passes through an upstream passage and the feed path includes one branch having a branch entry downstream of the upstream passage and another branch having a branch entry downstream of the upstream passage. The stream of material travels through the upstream passage thereafter separating into at least two portions with one portion of the material entering the one branch through its branch entry and thereafter traveling along the one branch and another portion of the material entering the another branch through its branch entry and thereafter traveling along the another branch in a manner in which the another portion of the material and the one portion of the material are segregated from one another during their respective travel along the one branch and the another branch. Also, the riffle distributor assembly is movable along a lateral axis perpendicular to the reference axis such that the one portion of the material and the another portion of the material, prior to their respective segregated travel along the one branch and the another branch, are comprised in unseparated manner in the stream of material as it travels through the upstream passage and the portions of the material thereafter travel in segregated manner in their respective branches with the travel properties of the one portion of the material in the one branch being different than its travel properties before the movement of the one branch entry relative to the reference axis.

According to another aspect of the present invention, the material feed apparatus is configured for cooperation with an associated furnace having the capability of burning coal which is delivered thereto as a mixture of pulverized coal and air.

DETAILED DESCRIPTION OF THE PREFERRED EMBODIMENT

Figure 1:
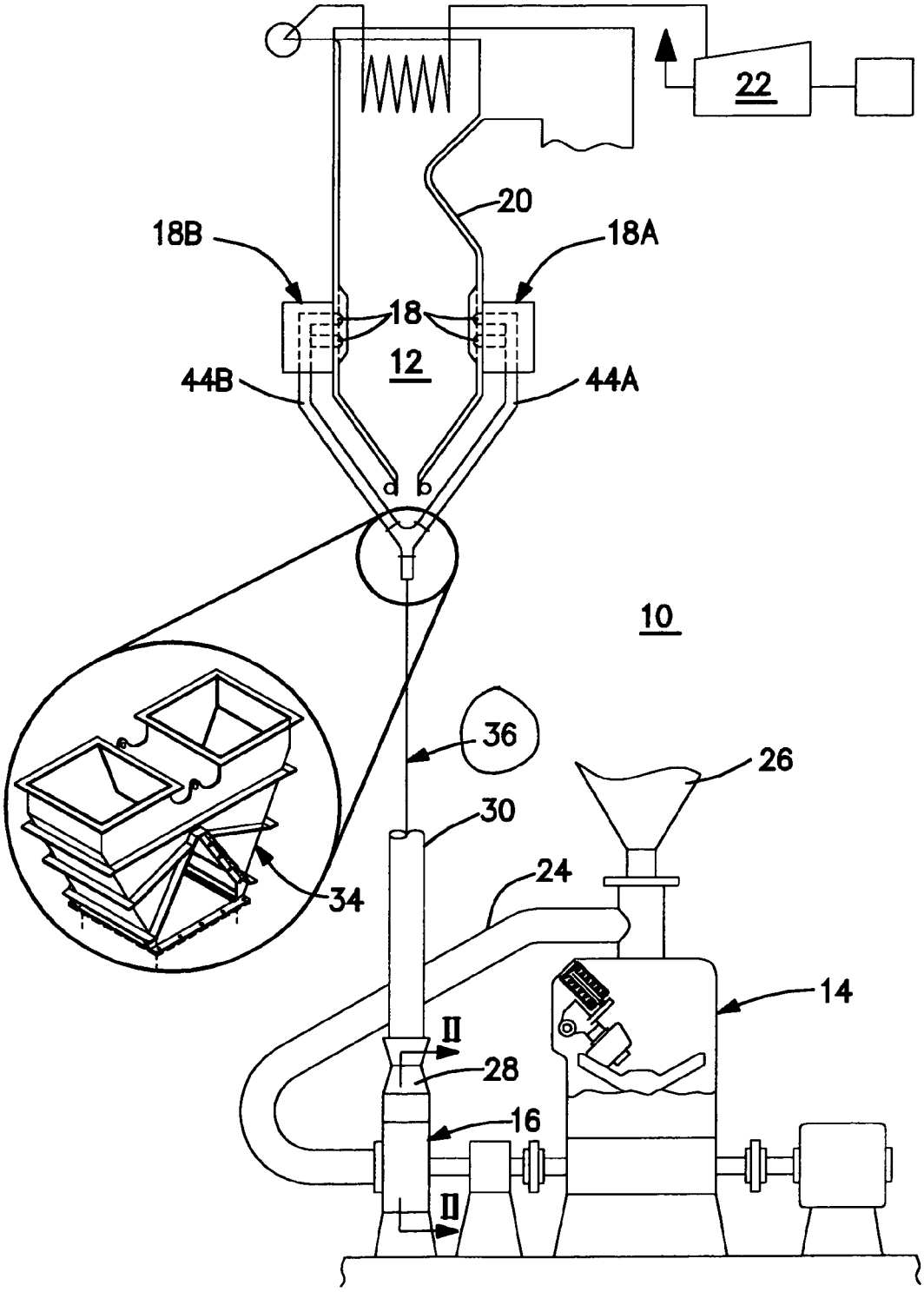
FIG. 1 is a front plan view, in partial section, of a fossil fuel combustion unit having a solid fuel pulverizer and exhauster system and a furnace for combusting a pulverized solid fuel and showing the one embodiment of the material feed apparatus of the present invention in its installed position in line between the solid fuel pulverizer and exhauster system and the furnace.

The material feed apparatus of the present invention will be described in detail in connection with the operation of the two embodiments of the material feed apparatus of the present invention to deliver a pulverized solid fuel and air mixture to a combustion vessel for combustion of the pulverized solid fuel in a combustion process. However, before the embodiments of the material feed apparatus of the present invention are described in detail, reference is had to FIG. 1 for a brief description of the components of the combustion process arrangement with which the two embodiments of the material feed apparatus of the present invention are specifically configured to operate.

In the combustion process arrangement, a solid fuel pulverizer and exhauster system 10 furnishes pulverized solid fuel to a furnace 12. The solid fuel pulverizer and exhauster system 10 comprises a pulverizer 14, and an exhauster 16 for effecting delivery of a mixture of hot gases and entrained fine solid fuel particles from the pulverizer 14 to the furnace 12. The furnace 12 operates in conventional manner to combust the pulverized solid fuel and air fed thereinto and, to this end, the pulverized solid fuel and air is injected into the furnace 12 through a plurality of burners 18. Additionally, the secondary air which is required to effectuate the combustion within the furnace 12 of the pulverized solid fuel that is injected thereinto through the burners 18. For illustration purposes herein, the burners 18 are arranged in two discrete clusters of burners with one burner cluster 18A having several burners commonly mounted along one corner of the furnace 12 and the other burner cluster 18B having several burners commonly mounted along another corner of the furnace 12.

The hot gases that are produced from combustion of the pulverized solid fuel and air rise upwardly in the furnace 12. During upward movement thereof in the furnace 12, the hot gases in a manner well-known to those skilled in this art give up heat to the fluid passing through the tubes 20 that in conventional fashion line all four of the walls of the furnace 12. Then, the hot gases exit the furnace 12 through a horizontal pass which in turn leads to a rear gas pass, both gas passes commonly comprising other heat exchanger surface (not shown) for generating and super heating steam, in a manner well-known to those skilled in this art. Thereafter, the steam commonly is made to flow to a turbine 22 which is in turn connected to a variable load, such as an electric generator (not shown), which in known fashion is cooperatively associated with the turbine 22, such that electricity is thus produced from the generator (not shown).

In a solid fuel feed operation, raw untrammeled solid fuel, which may be in the form of coal, is fed from a conventional coal storage silo 26 to the pulverizer 14 and is pulverized within the pulverizer 14. In turn, the pulverizer 14 is connected by means of an exhauster inlet duct 24 to the exhauster 16 whereby the solid fuel that is pulverized within the pulverizer 14 is entrained therewithin in an airstream and while so entrained therein is conveyed from the pulverizer 14 through the exhauster inlet duct 24 to the exhauster 16. The airstream with the pulverized solid fuel entrained therewith is made to pass through the exhauster 16 by virtue of the movement of a conventional exhauster fan assembly (not shown) rotatably mounted within the exhauster 16. The pulverized solid fuel while still entrained in the airstream is discharged from the exhauster 16 through an outlet 28. From the exhauster 16, the pulverized solid fuel entrained in the airstream is conveyed to the furnace 12 through an exhauster outlet duct 30 to the one embodiment of the material feed apparatus, hereinafter designated as the riffle distributor assembly 34. The riffle distributor assembly 34 optimally distributes the single stream of pulverized solid fuel delivered thereto by the exhauster outlet duct 30 into two respective branch feed paths, each of which delivers the pulverized solid fuel to a respective one of the two clusters of the burners 18, whereupon the pulverized solid fuel is injected into the furnace 12 by the burners 18 and combusted within the furnace 12.

Figure 7:
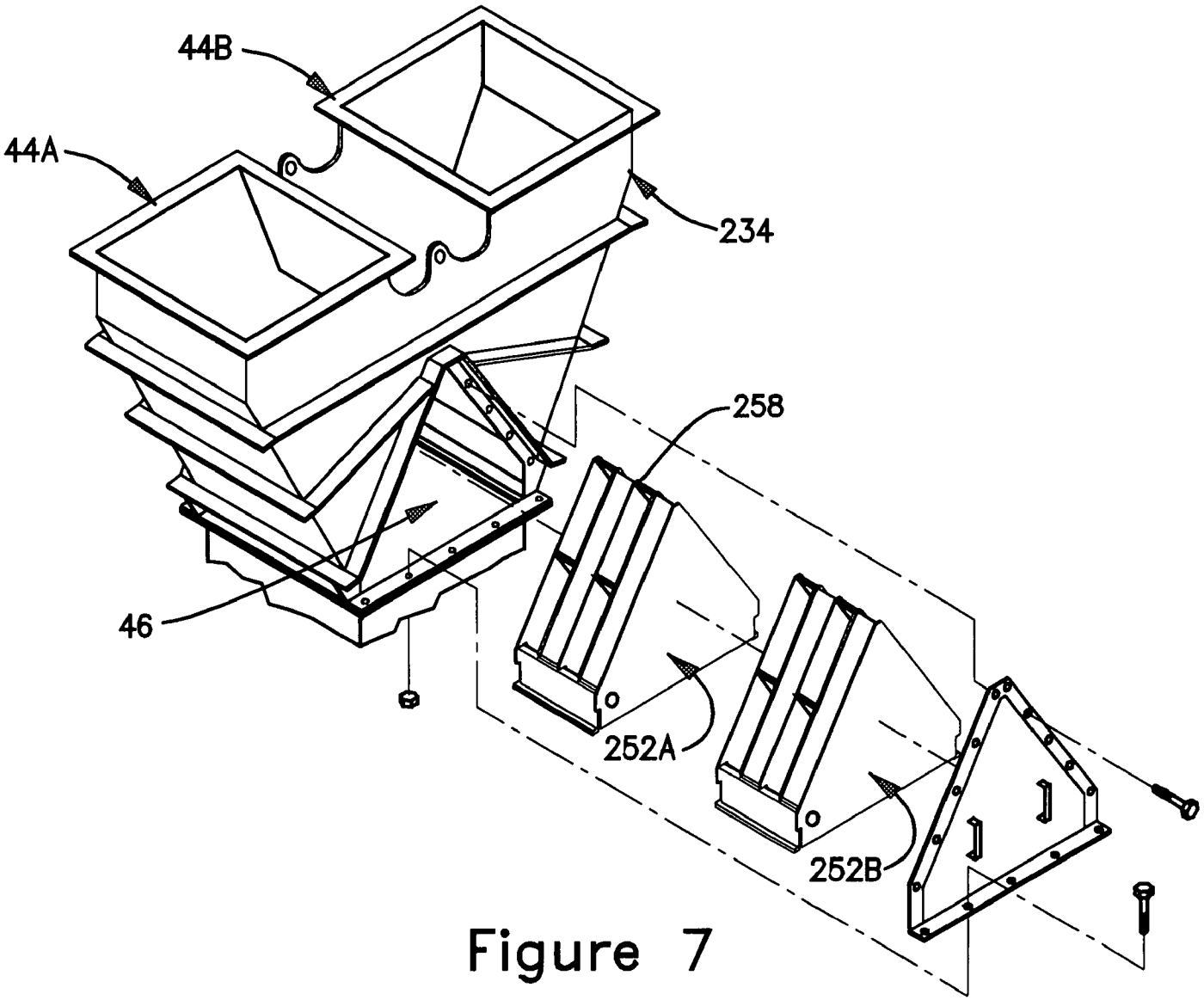
FIG. 7 is an enlarged perspective exploded view, in partial section, of another embodiment of the material feed apparatus of the present invention shown in its installed position in line between the solid fuel pulverizer and exhauster system and the furnace of the fossil fuel combustion unit shown in FIG. 1.

Reference is now had to FIGS. 2, 3*a*, 3*b*, 4*a*, 4*b*, 5*a*, and 5*b*, which illustrate one embodiment of the riffle distributor assembly 34, and to FIG. 7, which illustrates another embodiment of the riffle distributor assembly 34, for a more detailed description of the manner in which the riffle distributor assembly 34 is configured to feed a material from a material supply source to a delivery location and, more specifically, is configured to feed a material in the form of a comminuted solid fossil fuel—namely, pulverized coal—from a material supply source (the pulverizer 14) to a delivery location (the furnace 12).

Figure 2:
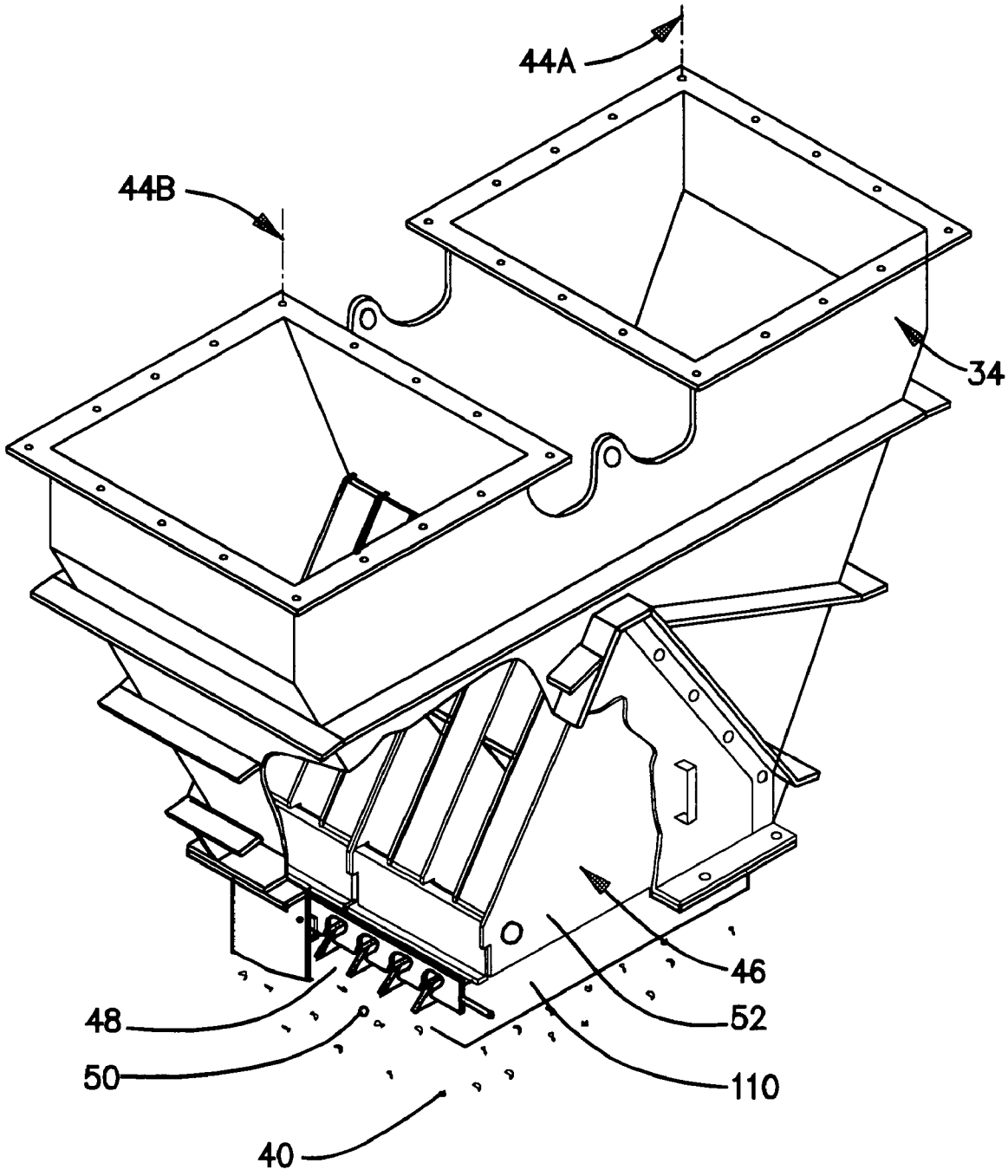
FIG. 2 is an enlarged perspective view, in partial section, of one embodiment of the material feed apparatus of the present invention shown in its installed position in line between the solid fuel pulverizer and exhauster system and the furnace of the fossil fuel combustion unit shown in FIG. 1 with the upstream passage periphery thereof in an initial upstream position during an initial material feed period.

As seen in particular in FIG. 2, the riffle distributor assembly 34 comprises part of a means forming a feed path 36 along which material in the form of pulverized coal particles 38 and air 40, hereinafter collectively designated as the material feed stream 42, is fed from a material supply source (the pulverizer 14) to a delivery location (the furnace 12). The feed path 36 comprises the various conventional components such as the exhauster 16, the exhauster inlet duct 24, the outlet 28, and the exhauster outlet duct 30 which convey the pulverized coal particles 38 and air 40 from the pulverizer 14 to the furnace 12 as well as additional components, to be described in more detail hereinafter, which convey the material feed stream 42 in a desired distributed load arrangement from the exhauster outlet duct 30 to the burners 18 of the furnace 12.

The material feed stream 42 fed along the exhauster outlet duct 30 must be distributed or allocated to the plurality of burners 18 in a manner which optimally supports the combustion process in the furnace 12. For example, the combustion process in the furnace 12 may be most optimally supported by an equal allocation or loading of the burners 18 with the material feed stream 42—in other words, a loading in which the same, or substantially the same, load of the material feed stream 42, as measured, for example, by mass flow rate, is fed to each burner 18 for injection thereby into the combustion chamber encompassed by the furnace 12. Alternatively, the combustion process in the furnace 12 may be most optimally supported, at a given operational time period, by an unequal allocation or loading of the burners 18 with a relatively higher load or allocation of the material feed stream 42 being fed to a selected one or ones of the burner 18 than is fed to others of the burners 18. The riffle distributor assembly 34 is configurable to support the desired burner loading arrangement such that the material feed stream 42 conveyed in the exhauster outlet duct 30 is distributed or allocated to the burners 18 in a manner which achieves the desired burner loading. It is to be noted that, in this regard, the riffle distributor assembly 34 can be alternatively configured as a fixed, non-adjustable device operable to distribute the material feed stream 42 in accordance with a single, predetermined distribution plan or as an adjustable device which can be adjusted to distribute the material feed stream 42 in accordance with one distribution plan during one operational period and to distribute the material feed stream 42 in accordance with another distribution plan different from the one distribution plan during another operational period. The configuration of the riffle distributor assembly as a fixed, non-adjustable device operable to distribute the material feed stream 42 in accordance with a single, predetermined distribution plan is shown in FIG. 7. The configuration of the riffle distributor assembly 34 as an adjustable device which can be adjusted to distribute the material feed stream 42 in accordance with one distribution plan during one operational period and to distribute the material feed stream 42 in accordance with another distribution plan different from the one distribution plan during another operational period is shown in FIGS. 2, 3*a*, 3*b*, 4*a*, 4*b*, 5*a*, and 5*b*, which illustrate the one embodiment of the riffle distributor assembly 34.

For the sake of illustrating several exemplary configurations of the riffle distributor assembly 34, the distribution of the material feed stream 42 by the riffle distributor assembly 34 to the burners 18 will be described with respect to a distribution plan in which the material feed stream 42 is distributed by the riffle distributor assembly 34 to a total of the two discrete burner clusters 18A, 18B, it being understood that the riffle distributor assembly 34 can, as desired, be configured to distribute a feed stream of material to, alternatively, more than two clusters of the burners 18. Additionally, the distribution of the material feed stream 42 can be effected, as the situation warrants, by any suitable arrangement of multiple units of the riffle distributor assembly 34 operating in parallel or in series.

Referring to FIG. 1, it can be seen that the riffle distributor assembly 34 distributes the material feed stream 42 to the pair of the burner clusters 18A, 18B by effecting a distribution or allocation of the material feed stream 42 being conveyed in the exhauster outlet duct 30 to two branch ducts 44A, 44B each separately communicated with a respective one of the burner clusters 18A, 18B for conveying the respective allocated portion of the material feed stream 42 thereto.

Referring now to FIGS. 2, 3*a*, 3*b*, 4*a*, 4*b*, 5*a*, 5*b*, and 6, which illustrate the one embodiment of the riffle distributor assembly 34, the riffle distributor assembly 34 comprises a transition zone 46 to which one respective end of each of the branch ducts 44A, 44B is communicated and which is axially spaced from a downstream end 50 of the exhauster outlet duct 30 with respect to an incoming flow reference axis IFA. The riffle distributor assembly 34 includes a plenum 48 that forms the downstream end 50 of the exhauster outlet duct 30 and forms, as well, the transition zone 46 such that the plenum 48, in its entirety, forms an enclosed space sealed against the outside extending from the downstream open end 50 of the exhauster outlet duct 30, through the transition zone 46, communicated with the branch ducts 44A, 44B.

The riffle distributor assembly 34 also includes a plurality of riffle element plates 52. The riffle element plates 52 are supported within the transition zone 46 and are adjustably positionably movable relative to the exhauster outlet duct 30 by an intake vane adjustment device 54 (shown in particular in FIG. 6 and to be described shortly hereafter) in a manner such that the intake vane adjustment device 54 for the riffle element plates 52 is operable to change the offset, or lateral position, of the intake openings of the riffle element plates 52 relative to a drive movement axis DMA perpendicular to the incoming flow reference axis IFA.

Figure 6:
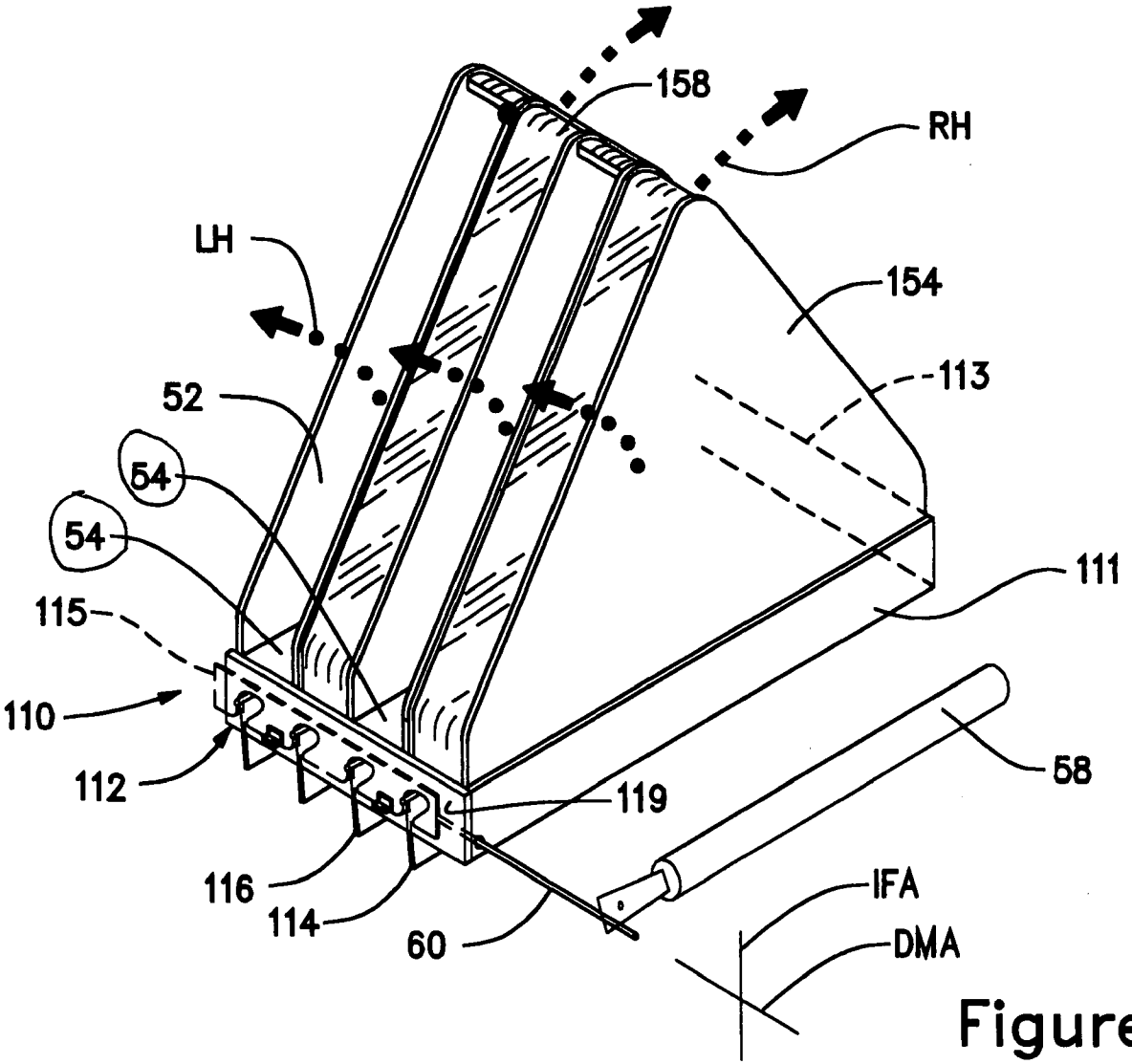
FIG. 6 is an enlarged perspective view of the riffle element plates of the one embodiment of the material feed apparatus of the present invention shown in its installed position in line in FIG. 1 and showing as well the drive motor assembly for adjustably positioning the intake vanes of the riffle element plates.

In the one embodiment of the present invention, and as best seen in FIG. 6, the intake openings of the riffle element plates 52 are formed by an adjusting vane sub-assembly 110 comprising a parallelepiped frame 112 and a plurality of intake vanes 114 each pivotally connected to a respective one of the riffle element plates 52 by a pivot connection 116. Reference is also had to FIG. 6 in conjunction with FIG. 8*a*, which is a side elevational sectional view, and FIG. 8*b*, which is a perspective view of one modification of the material feed apparatus of the present invention showing dual deflector plates mounted between each adjacent pair of the riffle element plates 52, wherein it can be seen that the parallelepiped frame 112 has a pair of opposed end panels 111, a right hand side panel 113, and a left hand side panel 115. The left hand side panel 115 of the parallelepiped frame 112 (which is shown in broken lines in FIG. 6 for the sake of clarity) has, along its inner longitudinal extent, a track 117 on which a slide drive 119 is slidably supported for sliding movement of the slide drive 119 along the track 117 in the direction of the DMA axis. Thus, the slide drive 119 extends parallel to the left hand side panel 115 of the parallelepiped frame 112 and is slidably supported thereon via the track 117 such that the slide drive 119 moves in the direction of the DMA axis relative to the parallelepiped frame 112.

The slide drive 119 includes a plurality of cut-outs 120 punched or cut out of the slide drive. The left hand side of each intake vane 114 is pivotally mounted at a respective pivot location 118 to the slide drive 119 such that one portion of the intake vane 114 extends into the respective generally triangularly shaped cut-out 120. The pivot location 118 at which each intake vane 114 is pivotally mounted to the frame 112 is spaced in the vertical direction along the IFA axis from the respective pivot connection 116 at which the intake vane 114 is pivotally connected to the respective one of the riffle element plates 52. The right hand side of each intake vane 114 is pivotally mounted to a respective pivot bore 121 formed in the right hand side panel 113 of the parallelepiped frame 112.

The intake vane adjustment device 54 of the riffle distributor assembly 34, as seen in FIG. 6, is comprised of a motor drive assembly 58 in the form of a step motor and a rod 60, the motor drive assembly 58 having a selectively reversibly rotatable shaft whose end is connected via an eccentric pusher to the rod 60. One end of the rod 60 is pivotally connected to an end of the slide drive 119. The step motor can be selectively actuated to effect extension and retraction movement of the rod 60 along the DMA axis such that the extension and retraction movement of the rod 60 along the DMA axis effects sliding movement of the slide drive 119 along the track 117 of the left hand side panel 115 relative the parallelepiped frame 112.

As seen in FIG. 6, the upstream edges of the intake vanes 114 form a plurality of intake spaces defined between adjacent intake vanes 114 which together define an upstream passage through which the feed path 36 passes. The material feed stream 42 exiting the downstream open end 50 of the exhauster outlet duct 30 is distributed or allocated by the riffle distributor assembly 34 such that the material comprising the material feed stream 42—namely, the pulverized coal 38 and air 36—which has traveled in a non-distributed or non-allocated manner through the upstream passage bounded by the intake spaces between adjacent intake vanes 114, is now distributed or allocated by the riffle distributor assembly 34 according to a predetermined distribution plan into respective portions segregated from one another during their travel along the respective branch ducts 44A, 44B to the burner clusters 18A, 18B.

The riffle distributor assembly 34 is thus configured as an apparatus for influencing the travel properties of a material (in the afore-described exemplary material feed scenario, the material is the material feed stream 42) moving between a material supply source (e.g., the pulverizer 14) and a delivery location (e.g., the furnace 12). The riffle distributor assembly 34 comprises a means forming a feed path 36 along which the material feed stream 42 travels as the material is enroute from the material supply source in the form of the pulverizer 14 to the delivery location in the form of the furnace 12. The feed path 36 passes through the intake areas defined between adjacent intake vanes 114 which are each at a predetermined lateral spacings from the incoming flow reference axis IFA (i.e., laterally along the DMA axis).

The feed path 36 includes one branch such as, for example, the branch duct 44A, having a branch entry downstream of intake areas defined between adjacent intake vanes 114, and another branch such as, for example, the branch duct 44B, having a branch entry downstream of the intake areas defined between adjacent intake vanes 114. The feed stream of the material 42 traveling through the intake areas defined between adjacent intake vanes 114 thereafter separates into two portions with one portion of the material feed stream 42 entering the one branch duct 44A through its branch entry and thereafter traveling along the one branch duct 44A and another portion of the material feed stream 42 entering the other branch duct 44B through its branch entry and thereafter traveling along this other branch in a manner in which the one portion of the material feed stream 42 and the other portion of the material feed stream 42 are segregated from one another during their respective travel along the one branch duct 44A and the other branch duct 44B.

As seen in FIG. 6, the riffle element plates 52 each have the same overall triangular shape and extend upwardly from their bases 154 parallel to one another along the IFA axis. The bases 154 are each fixedly mounted to the parallelipiped frame 112 and extend upwardly therefrom parallel to the IFA axis. Accordingly. Since each of the bases 154 of the riffle element plates 52 is fixedly mounted to the frame 112 and is, additionally, pivotally connected via a respective one of the pivot connections 116 to a respective one of the intake vanes 114, the sliding movement of the slide drive 119 relative to the frame 112 effects pivoting movement of the intake vanes 114 about their own pivot connections 118 in a manner in which the riffle element plates 52 remain in their fixed mounted positions parallel to one another while the intake vanes 114 pivot about their respective pivot connections 116 in a laterally left pivot movement or a laterally right pivot movement.

A deflector element 158 is mounted between each adjacent pair of the riffle element plates 52 and the deflector element 158 is a solid surface extending from the bases 154 of the adjacent pair of the riffle element plates 52 along the entirety of a respective side of the riffle element plates 52 to their topmost angle at which another respective side of the riffle element plates 52 begins. Accordingly, the respective adjacent sides of each adjacent pair of the riffle element plates 52 which are not covered by a deflector element 158 operate as open passages past which the material feed stream 42 can flow to thereby exit the transition zone 46 and enter a respective one of the branch ducts 44A, 44B. It can thus be appreciated that an alternating arrangement of the deflector elements 158 in which the deflector element 158 of every other adjacent pair of the riffle element plates 52 extends along the respective adjacent sides of each adjacent pair of the riffle element plates 52 which is opposite to the pair of adjacent sides of the next-following adjacent pair of the riffle element plates 52 on which its own deflector element 158 is mounted. This alternating arrangement is the arrangement of the deflector elements 158 of the one embodiment shown in FIG. 6 and, since this one embodiment comprises an equal number of alternately "right hand" and "left hand" deflected passages between the riffle element plates 52, the riffle element plates 52 are operable to deflect the mix of coal particles 38 and air 40 traveling between each adjacent pair of the riffle element plates 52 into a respective one of the branch ducts 44A, 44B, depending upon the placement of the respective deflector element 158, with one-half of the material feed stream 42 being deflected into the branch duct 44A, as is schematically shown by the dotted line arrow LH in FIG. 6, and the other one-half of the material feed stream being deflected into the branch duct 44B, as is schematically shown by the dash-square line RH.

The intake vane adjustment device 54 is operable to move the intake areas defined between adjacent intake vanes 114 in an offset or lateral direction relative to the incoming flow reference axis IFA (specifically, along the DMA axis) such that the one portion of the material feed stream 42 and the other portion of the material feed stream 42, prior to their respective segregated travel along the one branch duct 44A and other branch duct 44B, are comprised in unseparated manner in the stream of the material feed stream 42 as it travels through intake areas defined between adjacent intake vanes 114 and thereafter travel in segregated manner in their respective branch ducts 44A, 44B with the travel properties of the one portion of the material feed stream 42 in the one branch duct 44A being different than its travel properties before the offset or lateral movement of intake areas defined between adjacent intake vanes 114 relative to the incoming flow reference axis IFA.

An understanding of how the travel properties of the one portion of the material feed stream 42 in the one branch duct 44A are different than its travel properties before the lateral or offset movement of intake areas defined between adjacent intake vanes 114 can be gained from a more detailed description of the manner in which the intake vanes 114 influence the distribution of the material feed stream 42 into the branch ducts 44A, 44B. The offset or lateral positions of the intake vanes 114 influence the distribution of the material feed stream 42 into the branch ducts 44A, 44B for the reason that the intake vanes 114 influence the overall path of movement of the feed stream of material as it exits the downstream open end 50 of the exhauster outlet duct 30.

Figure 3B:
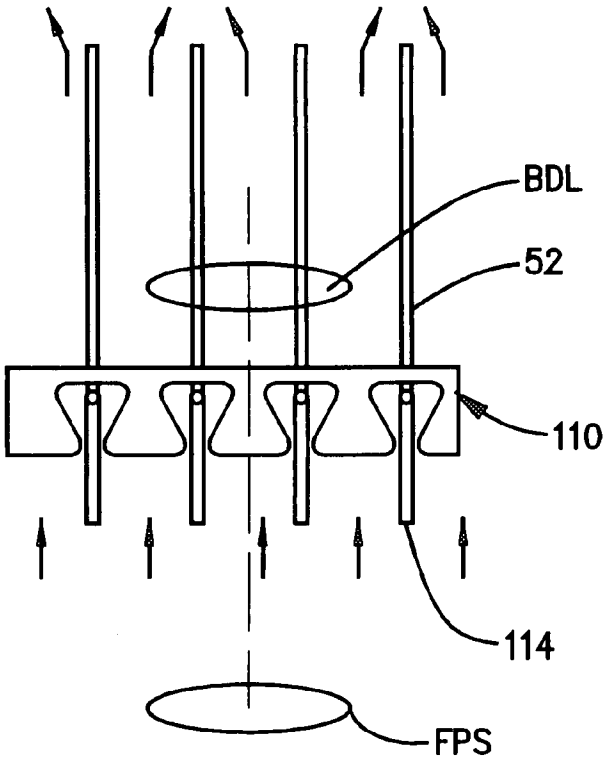
FIG. 3*b* is a side elevational schematic view of the riffle elements of the upstream passage assembly in the non-offset upstream position of the upstream passage assembly shown in FIG. 3*a;*

The influence of the lateral or offset positions of the intake vanes 114 on the distribution of the material feed stream 42 into the branch ducts 44A, 44B is hereinafter explained with reference to FIGS. 2, 3*a*, 3*b*, 4*a*, 4*b*, 5*a*, and 5*b*. As seen in FIG. 3*b*, which is a schematic side elevational view of the positions of the riffle element plates shown in FIG. 3 during an initial material feed period, the material feed stream 42 may have, for example, an instantaneous cross-sectional distribution of the coal particles 38 across a lateral cross-section of the downstream end 50 of the feed path 36 characterized by the property that substantially the same proportion of the coal particles 38 in the lateral cross-section enters into each respective intake area defined between an adjacent pair of intake vanes 114. In other words, for illustration purposes herein, it is assumed that the instantaneous cross-sectional distribution of the coal particles 38 across a lateral cross-section of the downstream end 50 of the feed path 36 is such that an approximately equal amount of coal particles 38 enter between each adjacent pair of the intake vanes 114, whereupon the alternating right- and left-handedness arrangement of the riffle element plates 52 ensures that approximately the same amount of the coal particles 38 in the instantaneous lateral cross-section of the downstream end 50 of the feed path 36 enter each of the branch ducts 44A, 44B. The instantaneous cross-sectional distribution of the coal particles 38 across the lateral cross-section of the downstream end 50 of the feed path 36 is designated as the upstream feed distribution FPS and the cross-sectional distribution of the coal particles 38 during their passage through the branch ducts 44A, 44B is designated as the downstream feed distribution BDL. It can be seen in FIG. 3*b* that the intake vanes 114 are, during the initial feed period, in alignment with the axis IFA; this position of the intake vanes 114 is deemed to be a no or zero offset position.

Figure 3A:
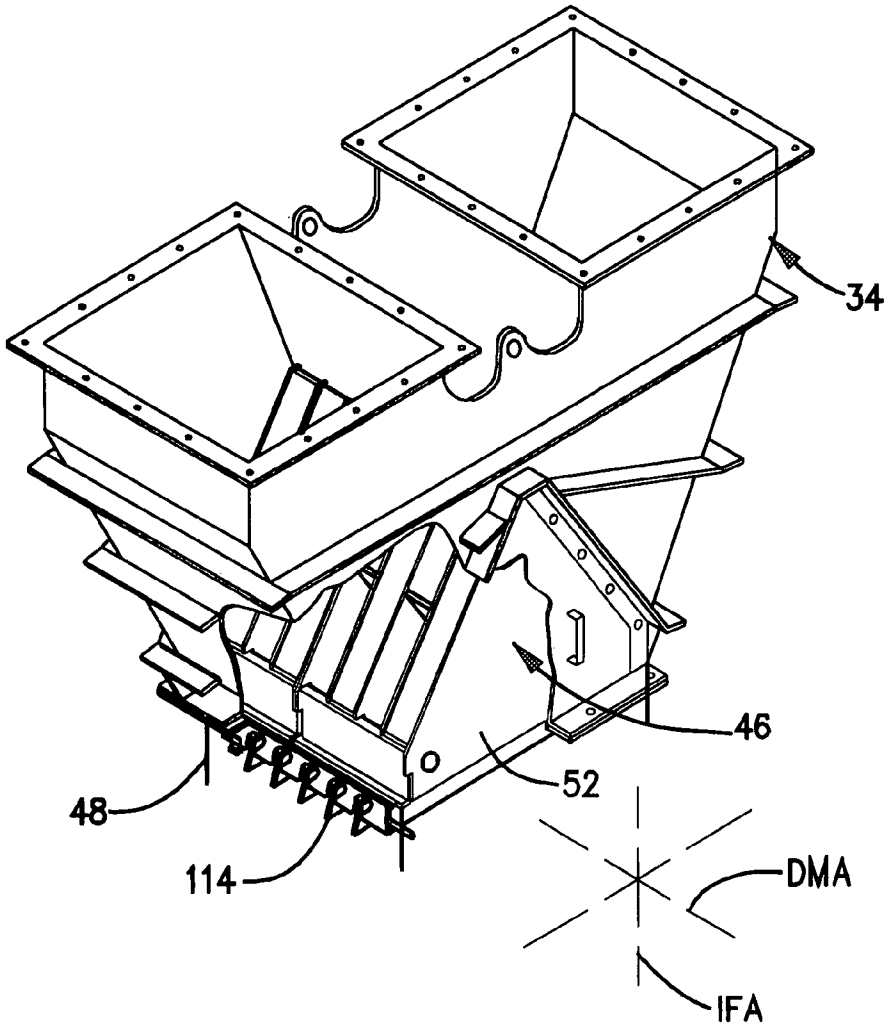
FIG. 3*a* is an enlarged perspective view, in partial section, of one embodiment of the material feed apparatus of the present invention shown in its installed position in line in FIG. 1 and showing with the upstream passage assembly thereof in an non-offset upstream position during an initial material feed period.
Figure 4B:
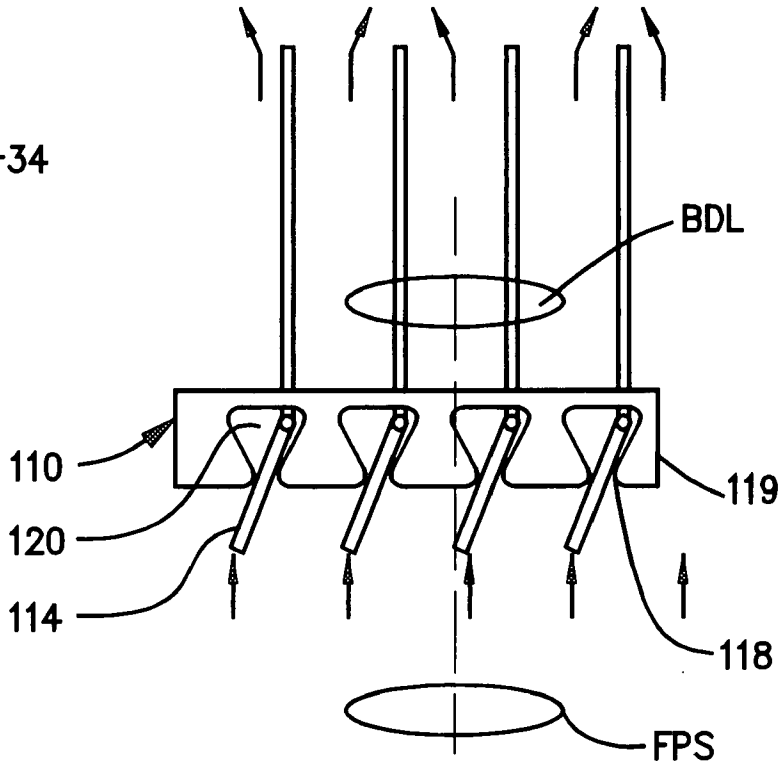
FIG. 4*b* is a side elevational schematic view of the riffle elements of the upstream passage assembly in the right-hand offset upstream position of the upstream passage assembly shown in FIG. 4*a;*
Figure 4A:
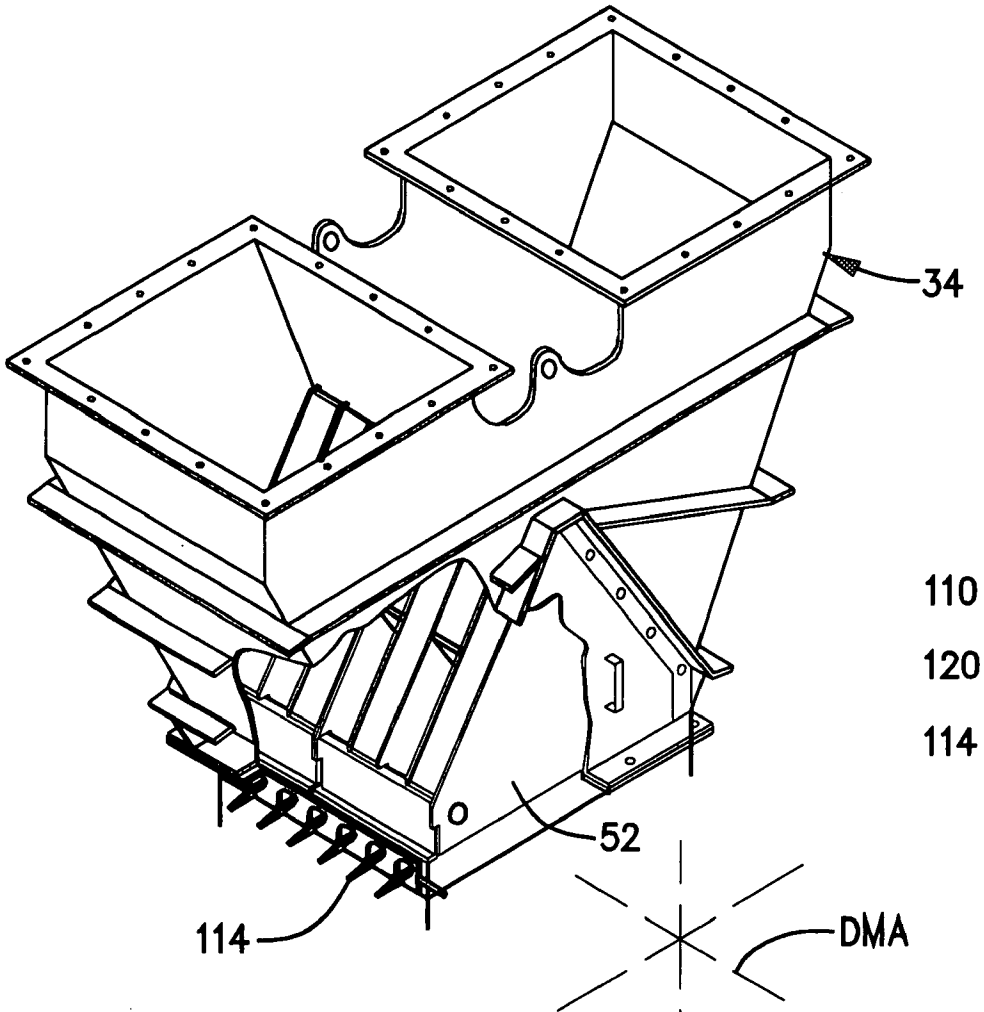
FIG. 4*a* is an enlarged perspective view, in partial section, of one embodiment of the material feed apparatus of the present invention shown in its installed position in line in FIG. 1 and showing with the upstream passage assembly thereof in a right-hand offset upstream position during a subsequent material feed period.

The downstream feed distribution BDL changes in correspondence with the change in the lateral or offset positions of intake areas defined between adjacent intake vanes 114 from the initial upstream position during an initial material feed period shown in FIGS. 3 and 3*b* to a subsequent upstream position during a subsequent material feed period following the initial material feed period. With particular reference to FIGS. 4 and 4*b*, it can be seen that a lateral or offset movement of the intake vanes 114 effects a change in the downstream feed distribution BDL. The motor drive assembly 58 changes the lateral position of intake areas defined between adjacent intake vanes 114 to effect a change in the downstream feed distribution BDL. With reference to FIGS. 4 and 4*a*, it can be seen that the downstream feed distribution BDL has been offset during the subsequent material feed period in that the downstream feed distribution BDL schematically shown in FIG. 4*a* has now shifted the cross-sectional distribution of the coal particles 38 to the right-hand side, as viewed in FIG. 4*a*, such that proportionally more of the coal particles 38 in the upstream feed distribution FPS enter into the respective passages between the riffle element plates 52 toward the right hand side than those passages between the riffle element plates toward the left hand side. As is schematically shown in FIG. 4*a*, by reason of the lateral or offset movement of the stream feed distribution BDL during the subsequent material feed period, those passages between adjacent pairs of the riffle element plates 52 communicated with the branch duct 44B toward the right hand side now collectively define a relatively greater passage volume than those passages between adjacent pairs of the riffle element plates 52 communicated with the branch duct 44A toward the left hand side, whereupon proportionately more of the coal particles 38 in the cross-sectional distribution flow from the transition zone 46 into the branch duct 44B than flow into the branch duct 44A, and, consequently, the burner cluster 18B communicated with the branch duct 44B receives a larger pulse of coal particles 38 than the burner cluster 18A.

Figure 5B:
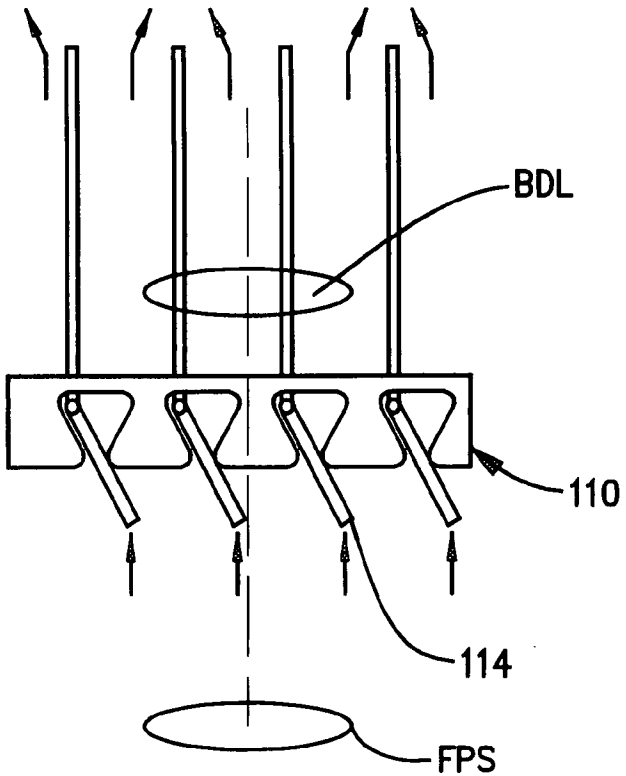
FIG. 5*b* is a side elevational schematic view of the riffle elements of the upstream passage assembly in the right-hand offset upstream position of the upstream passage assembly shown in FIG. 5*a;*
Figure 5A:
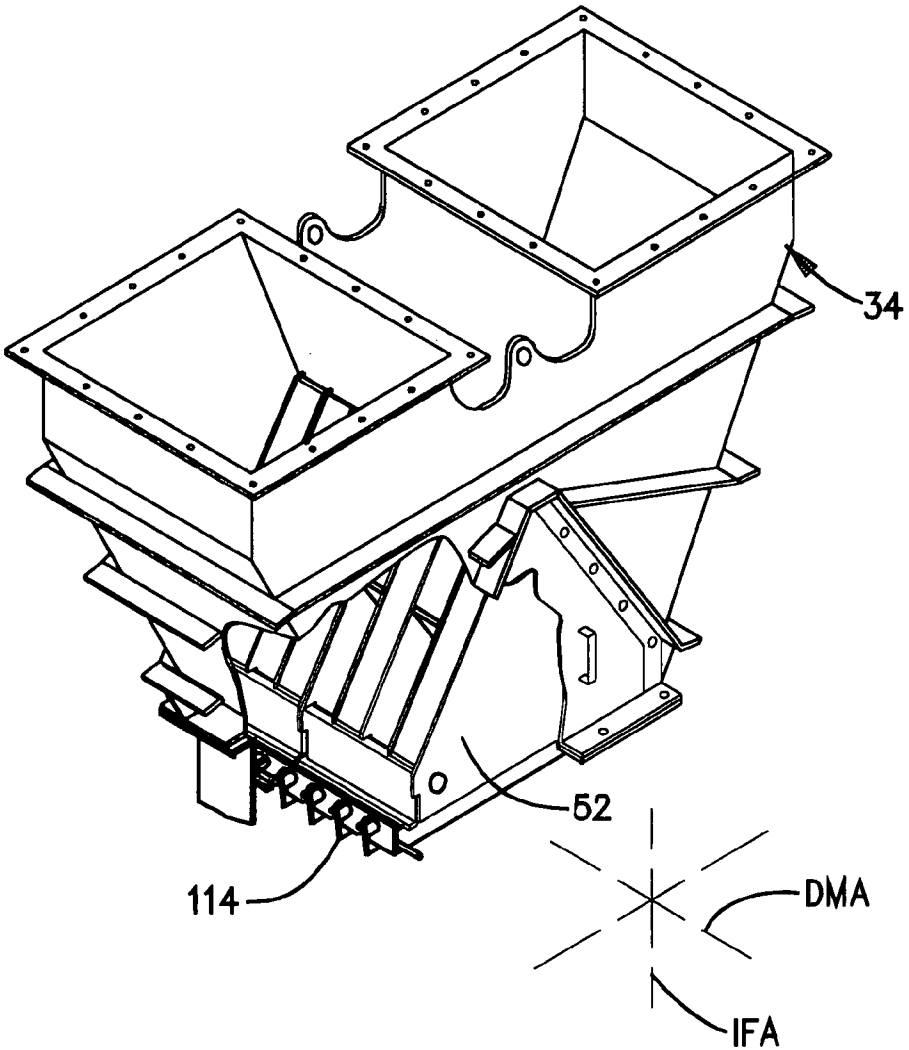
FIG. 5*a* is an enlarged perspective view, in partial section, of one embodiment of the material feed apparatus of the present invention shown in its installed position in line in FIG. 1 and showing with the upstream passage assembly thereof in a right-hand offset upstream position during yet another subsequent material feed period.

FIGS. 5 and 5*b* illustrate a different subsequent material feed period in which the downstream feed distribution BDL has been offset during this subsequent material feed period in that the downstream feed distribution BDL schematically shown in FIG. 5*a* has now shifted the cross-sectional distribution of the coal particles 38 to the left-hand side, as viewed in FIG. 5*a*, such that proportionally more of the coal particles in the upstream feed distribution FPS enter into the respective passages between the riffle element plates 52 toward the left hand side than those passages between the riffle element plates toward the right hand side.

FIG. 7 is an enlarged perspective exploded view, in partial section, of another embodiment of the material feed apparatus of the present invention shown in its installed position in line between the solid fuel pulverizer and exhauster system 10 and the furnace 12 of the fossil fuel combustion unit shown in FIG. 1. In this embodiment, the riffle distributor assembly, which is herein designated as the riffle distributor assembly 234, is configured as a fixed, non-adjustable device operable to distribute the material feed stream 42 in accordance with a single, predetermined distribution plan. The riffle distribution assembly 234 includes two sets of riffle element plates 252A, 252B which are mounted one behind the other along the DMA axis in the transition zone 46. The riffle element plate 252A comprises a plurality of deflector elements 258 which each mounted between a respective adjacent pair of the riffle element plates 252A on the same respective side of the riffle element plates 252A—namely, the left hand side of the riffle element plates 252A as viewed in FIG. 7. Thus, the riffle element plates 252A operate to guide the material feed stream 42 in the transition zone 46 into the branch duct 44A. The riffle element plate 252B comprises a plurality of deflector elements 258 which each mounted between a respective adjacent pair of the riffle element plates 252A on the same respective side of the riffle element plates 252B—namely, the right hand side of the riffle element plates 252B as viewed in FIG. 7. Thus, the riffle element plates 252B operate to guide the material feed stream 42 in the transition zone 46 into the branch duct 44B.

Figure 8A:
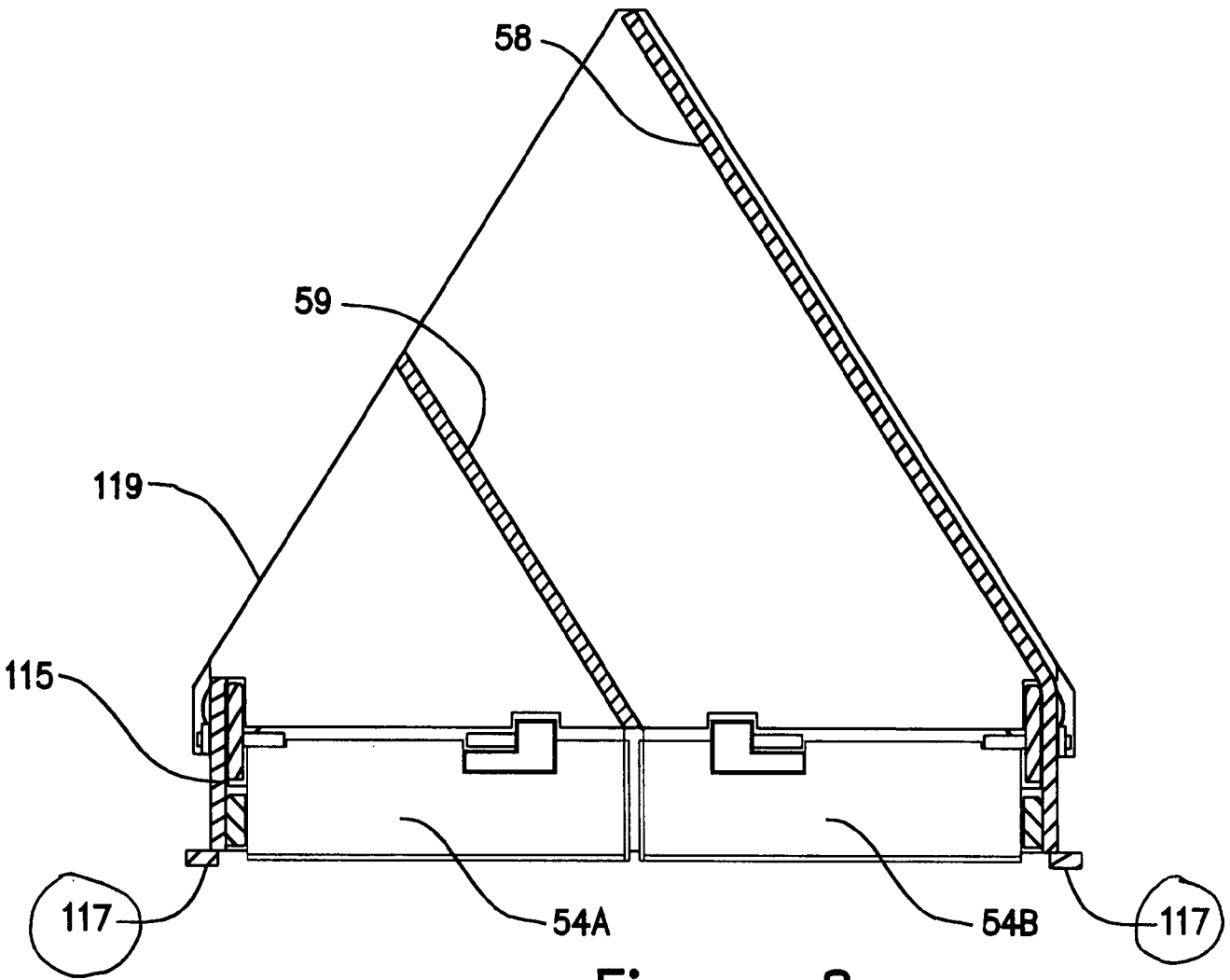
FIG. 8*a* is a side elevational sectional view of one modification of the one embodiment of the material feed apparatus of the present invention showing dual deflector plates mounted between each adjacent pair of the riffle element plates.
Figure 8B:
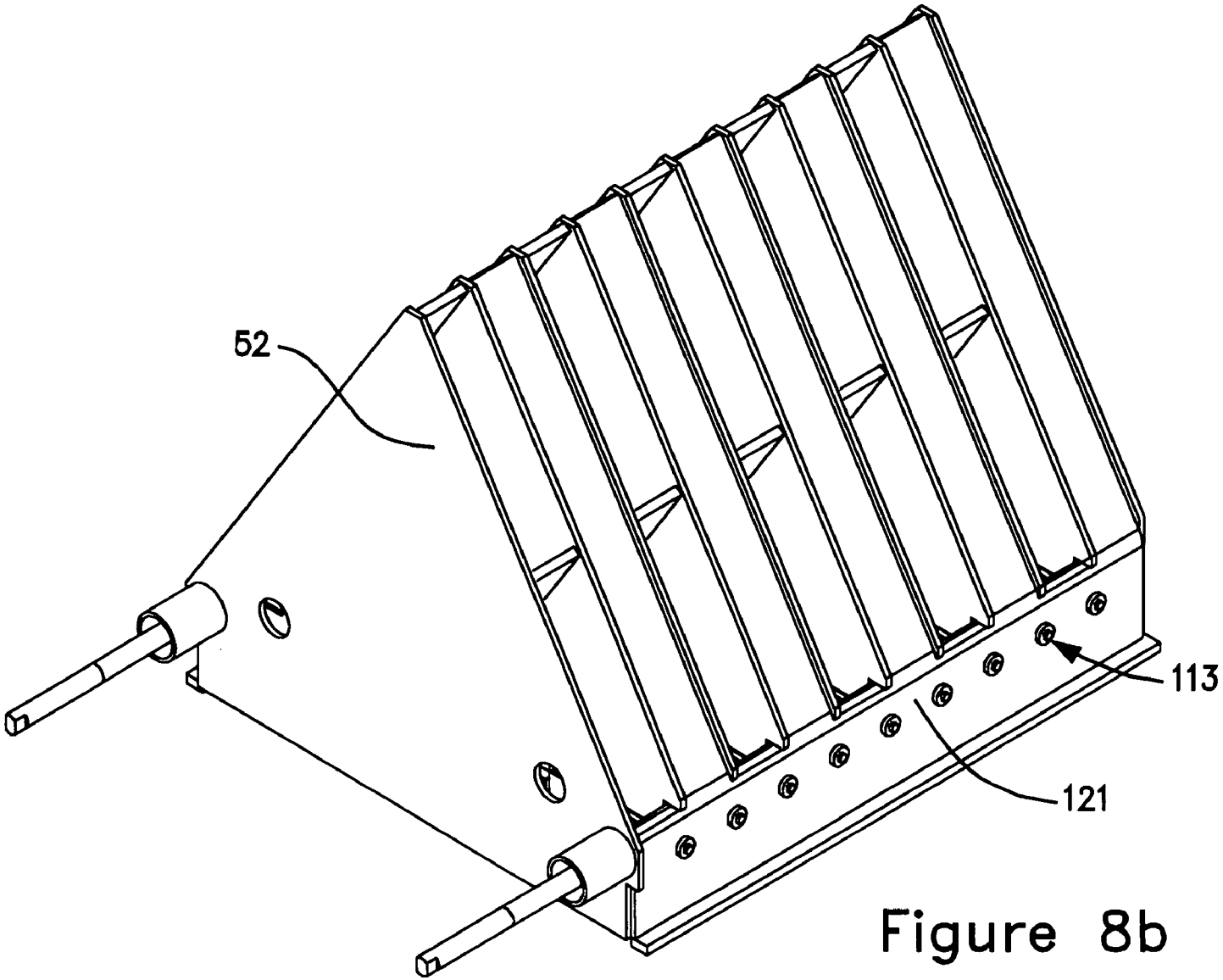
FIG. 8*b* is a perspective view of the one modification of the material feed apparatus of the present invention shown in FIG. 8*a*.

FIG. 8*a* is a side elevational sectional view and FIG. 8*b* is a perspective view of one modification of the material feed apparatus of the present invention showing dual deflector plates mounted between each adjacent pair of the riffle element plates 52. Thus, in addition to the deflector plate 58 mounted between each adjacent pair of the riffle element plates 52, in this modification of the one embodiment of the present invention, there is also a mid-position deflector plate 59 mounted between each adjacent pair of the riffle element plates 52 and extending parallel to the respective deflector plate 58. Also, each respective intake vane 114 associated with a respective riffle element plate 52 is configured as two independently pivotally vane portions 114A, 1144B, wherein each vane portion 114A influences the travel of the material feed stream 42 into those respective volumes defined between adjacent pairs of the riffle element plates 52 on the same respective one side of the mid-position deflector plates 59 and each vane portion 114B influences the travel of the material feed stream 42 into those respective volumes defined between adjacent pairs of the riffle element plates 52 on the same respective other side of the mid-position deflector plates 59.

The present invention thus provides an apparatus for feeding material between a material supply location and a delivery location which permits more precise and reliable control of the distribution of the material between two or more branch feed paths. Also, the inventive apparatus for feeding material between a material supply location and a delivery location distributes material between two or more branch feed paths in a manner which minimizes any loss of pressure. Moreover, the inventive apparatus for feeding material between a material supply location and a delivery location can distribute a mixture comprised of a fluid transport material and a solid material between two or more branch feed paths in a manner in which the distribution of the fluid transport material between the branch feed paths remains substantially the same following a re-distribution of the entrained solid material between the branch paths.

While an embodiment and variations of the present invention have been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

What is claim is:

1. A riffle distributor assembly for delivering pulverized solid fuel from an exhauster having a downstream open end to a pair of branch ducts each having an upstream end for distribution to at least a pair of burners mounted in a combustion vessel in order that the pulverized solid fuel can be combusted in a combustion process in the combustion vessel, said riffle distributor assembly comprising:

a plenum forming an enclosed space extending from the downstream open end of the exhauster to the upstream end of each of the pair of branch ducts;

a plurality of riffle element plates supported within said plenum, each of said plurality of riffle elements having an intake opening;

each intake opening of each of said plurality of riffle element plates being formed by a vane subassembly;

said vane subassembly including a parallelepiped frame and a plurality of intake vanes;

said parallelepiped frame having a first side panel and a second side panel;

each of said plurality of intake vanes having a first side and a second side, and each of said plurality of intake vanes being pivotally connected by a pivot connection to a respective one of said plurality of riffle element plates;

a slide drive slidably supported for sliding movement of said slide drive in a first direction, said slide drive including a plurality of cut-outs;

said first side of each of said plurality of intake vanes being pivotally mounted at a respective pivot location to said slide drive such that a portion of each of said plurality of intake vanes extends into a respective one of said plurality of cut-outs;

said respective pivot location at which each of said plurality of intake vanes is pivotally mounted to said slide drive is spaced in a second direction from the respective pivot connection at which each of said plurality of intake vanes is pivotally connected to the respective one of said plurality of riffle element plates; and said second side of each of said plurality of intake vanes being pivotally mounted to a respective pivot bore formed in a first side panel of said parallelepiped frame.

2. The riffle distributor assembly as set forth in claim 1 wherein said plurality of intake vanes are each movable between a zero offset position and an offset position so as to vary the amount of pulverized solid fuel distributed to each of said pair of branch ducts.

3. The riffle distributor assembly as set forth in claim 2 further including an intake vane adjustment device comprising:

a motor drive assembly including a step motor and a rod;

said step motor having a selectively reversibly rotatable shaft, one end of said selectively reversibly rotatable shaft being connected to said rod;

one end of said rod being pivotally connected to said slide drive; and said step motor being selectively actuatable to effect extension and retraction of said rod in said first direction such that the extension and retraction of said rod in said first direction effects sliding movement of said slide drive so as to thereby cause said plurality of intake vanes to move between said zero offset position thereof and said offset position thereof.

* * * * *